United States Patent [19]

Mineo

[11] 3,987,929

[45] Oct. 26, 1976

[54] CAP SEAL FOR DRUM

[75] Inventor: Kinji Mineo, Tokyo, Japan

[73] Assignee: Yamato Iron Works Co., Ltd., Tokyo, Japan

[22] Filed: Mar. 3, 1975

[21] Appl. No.: 554,431

[30] Foreign Application Priority Data

Mar. 4, 1974 Japan ..... 49-25911[U]

[52] U.S. Cl. ..... 220/257; 220/266; 220/306; 215/317

[51] Int. Cl.[2] ..... B65D 17/00

[58] Field of Search ..... 220/257, 265, 266, 267, 220/306; 215/321, 320, 317

[56] References Cited

UNITED STATES PATENTS

| | | | |
|---|---|---|---|
| 1,982,145 | 11/1934 | Shera | 220/257 |
| 2,156,540 | 5/1939 | Helrath | 220/257 |
| 2,760,671 | 8/1956 | Parish, Jr. | 220/257 |
| 2,837,236 | 6/1958 | Betner | 220/257 |
| 3,122,261 | 2/1964 | Parish, Jr. et al. | 220/257 |
| 3,269,588 | 8/1966 | Ruekberg | 220/306 |

*Primary Examiner*—William Price
*Assistant Examiner*—Joseph M. Moy

[57] ABSTRACT

Cap seal made of a material having some elasticity and including a circular top wall, a peripheral wall and an inward annular projection formed on the inner surface of the peripheral wall and engageable with an outwardly projecting edge at the upper end of a mouthpiece of a drum. Each of the circular top wall and the peripheral wall is formed with a groove for removing the cap seal.

1 Claim, 8 Drawing Figures

CAP SEAL FOR DRUM

BACKGROUND OF THE INVENTION

This invention relates to a cap seal for drums.

When a drum or drum can is filled with contents and a plug is thereafter screwed into the mouthpiece on the cylindrical mouth of the can, a cap seal is fitted over the pluged mouth for sealing. For this purpose cap seals made of metal are known which comprise a circular top wall and a peripheral wall and has an inverted U-shaped vertical section. Such cap seal is fitted over the cylindrical mouth of drum using a sealing tool. The cap seal is placed over the cylindrical mouth by the hand, and the peripheral lower end portion of the seal is pressed inward by the sealing tool to deform the peripheral end portion along the outwardly projecting upper edge of the mouthpiece. Thus the sealing procedure with the use of cap seal is very troublesome and inefficient, requires skill and the tool, and is therefore costly.

SUMMARY OF THE INVENTION

The object of this invention is to provide a cap seal free of the foregoing problems.

The cap seal of this invention is made of a material having some elasticity and including a circular top wall, a peripheral wall and an inward annular projection formed on the inner surface of the peripheral wall and engageable with an outwardly projecting edge at the upper end of a mouthpiece of a drum. The circular top wall and the peripheral wall is each formed with a groove for removing the cap seal from the mouthpiece.

The cap seal of this invention can be easily fitted over the cylindrical mouth of drum only by the hand. Accordingly, the cap seal can be placed in position with extreme ease and without any necessity to use the sealing tool conventionally employed. The present invention therefore assures a very smooth operation for sealing drums as finished products after the drums have been filled up with the specified contents.

DESCRIPTION OF THE PREFERRED EMBODIMENTS

Figure 1:
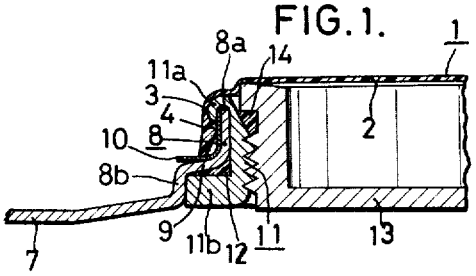
FIG. 1 is a fragmentary view in vertical section showing an embodiment of the cap seal of this invention as it is fitted over the cylindrical mouth of a drum.
Figure 2:
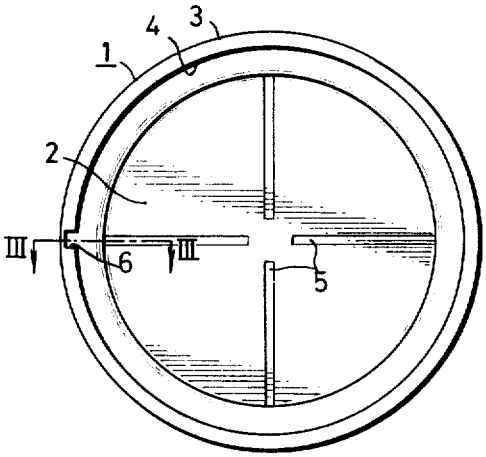
FIG. 2 is a bottom view showing the embodiment of FIG. 1 only.
Figure 3:
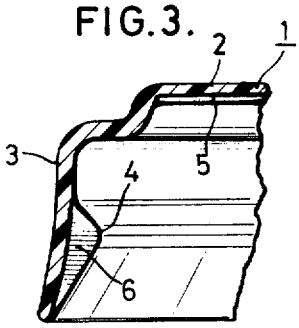
FIG. 3 is an enlarged fragmentary view in vertical section taken along the line III—III in FIG. 2.

With reference to FIGS. 1 to 3, a cap seal 1 is made of synthetic resin such as polypropylene, polyethylene, nylon, polystyrene, polyvinyl chloride or the like. The cap seal 1 includes a circular top wall 2, a peripheral wall 3 and an inward annular projection 4 horizontally provided on the inner surface of the peripheral wall 3 at the middle of the height of the wall 3. The circular top wall 2 is formed in its under surface with grooves 5 radially or diametrically extending crosswise and serving to remove the cap seal 1 from its fitted position. The lower end portion of the peripheral wall 3 extends outward toward its lower extremity. In the inner surface of the peripheral wall 3 there is formed a vertical groove 6 positioned on a line extending from the removing groove 5. These removing grooves 5 and 6 are formed to render the cap seal 1 readily removable. Although it is preferable to form many radial removing grooves 5 in the circular top wall 2, at least one groove 5 may be provided. However since the removing vertical groove 6 provided in the peripheral wall 3 is not desirable to the ability of the seal cap 1 to seal the mouth of drum, it is objectionable to form many grooves 6 in the peripheral wall 3. In some cases, accordingly, the groove 6 need not be formed.

The drum has a top plate 7 provided with a cylindrical mouth 8 including an annular stepped portion 9 at the middle of the height of the mouth 8 to define an upper part 8*a* having a smaller diameter than a lower part 8*b*. A washer 10, L-shaped in cross section, is fitted around the upper part 8*a* of the cylindrical mouth 8. Disposed in the cylindrical mouth 8 is a mouthpiece 11 in the form of a cylinder having female screw threads. The upper edge 11*a* of the mouthpiece 11 is folded over to fasten the top edge of the mouth 8 and the top edge of the washer 10 together in the folded portion. The mouthpiece 11 further has a flange 11*b* integral therewith. The outer periphery of the flange 11*b* is in contact with the inner surface of the lower part 8*b* of the mouth 8. An annular gasket 12 is interposed between the lower end of the mouthpiece 11 and the cylindrical mouth 8. Another annular gasket 14 is fixedly fitted around the upper end of a plug 13 screwed into the mouthpiece 11. Drums are not always provided with the washer 10.

The cap seal 1 is fitted over the mouthpiece 11 after the plug 13 has been screwed into the mouthpiece 11 mounted on the mouth 8 to close the mouth. To fit the seal 1 in position, the seal 1 is placed over the mouthpiece 11 and depressed from above, whereby the inward annular projection 4 on the peripheral wall 3 of the seal 1, which is made of a material having some elasticity, is temporarily expanded outward by the folded-over outwardly projecting edge 11*a* of the mouthpiece 11, is thereafter forced over the outward projecting edge 11*a* and comes into contact with the outer surface of the washer 10 by virtue of the ability of the peripheral wall 3 to restore itself. Thus the cap seal 1 is fitted over the mouthpiece 11. Because the peripheral wall 3 is so formed that the inner surface of its lower end portion extends progressively outward toward its lower extremity, the cap seal 1 is very easy to fit in place. The cap seal 1 is held against displacement when thus mounted in place, with the inward annular projection 4 in engagement with the outwardly projecting edge 11*a* of the mouthpiece 11.

To remove the cap seal 1 from the mouthpiece 11, the center of the circular top wall 2 is struck on its top surface for example with a hammer or the like to crack the top wall along the radial groove or grooves 5 in the under surface. The finger or suitable tool is then inserted into the crack to tear off the cap seal 1 in pieces along the vertical groove 6 in the peripheral wall 3.

Figure 4:
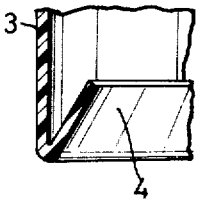
FIG. 4 is an enlarged fragmentary view in vertical section showing another embodiment of this invention.

FIG. 4 shows another embodiment of the cap seal of this invention. It is made of tinplate, aluminum sheet, noncorrosive steel sheet or like metal sheet having some elasticity. In this embodiment, the lower end of the peripheral wall 3 is folded inward to provide the inward annular projection 4.

Figure 5:
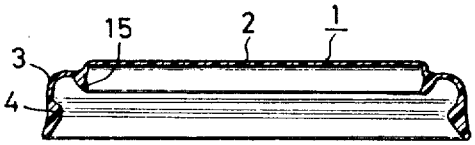
FIG. 5 is a view in vertical section showing another embodiment of this invention.

FIG. 5 shows another embodiment of the cap seal of this invention in which the circular top wall 2 is formed, on its under surface close to the peripheral wall 3, with a downward annular projection 15. When the cap seal 1 is fitted over the mouthpiece 11, the outwardly projecting edge 11*a* at the upper end of the mouthpiece 11 is gripped by the downward annular projection 15 and the inward annular projection 4 on the peripheral wall 3. Furthermore, the downward annular projection 15 comes into intimate contact with the upper end outer surface of the plug 13 to completely seal the space between plug 13 and the mouthpiece 11 like the gasket 14. To make the cap seal 1 readily removable, the downward annular projection 15 is preferably formed with a removing groove, like the removing vertical groove 6 formed in the inward annular projection 4. This groove is positioned on a line extending from the radial removing groove 5 in the circular top wall 2.

Figure 6:
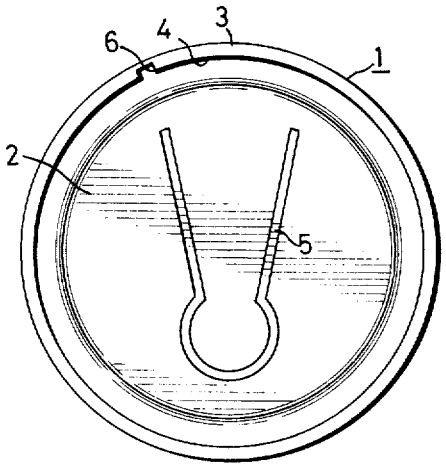
FIGS. 6 to 8 are bottom views each showing a cap seal having a modified removing groove.
Figure 7:
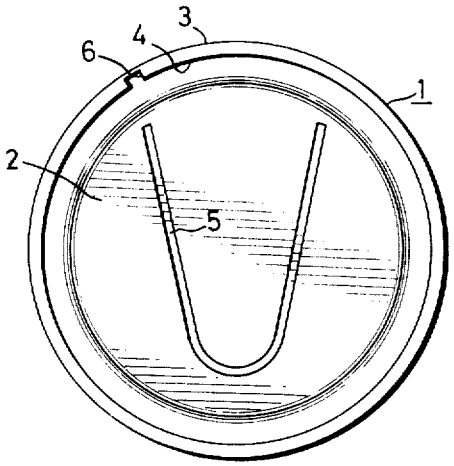
Figure 8:
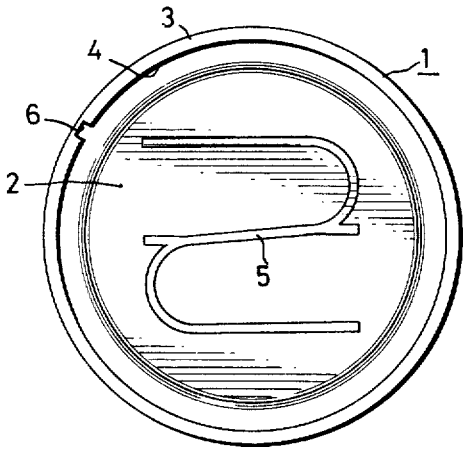

FIGS. 6 to 8 show other embodiments of the cap seal of this invention in which the shape of the removing groove 5 in the circular top wall 2 is modified variously. The removing groove 5 shown in FIG. 6 is substantially U-shaped and has a circular arc lower end. FIG. 7 shows a removing groove 5 which is U-shaped. Further FIG. 8 shows a removing groove which is in the form of two partly overlapping U-shaped grooves which are arranged in opposite directions to each other. The cap seals 1 having removing grooves 5 of these shapes in the top wall 2 are very easy to remove from the sealing position.

Without departing from the spirit and the basic features of this invention, the present invention can be embodied in other modifications and alterations. Accordingly, the embodiments herein disclosed are given for illustrative purposes only and are not limitative in any way. Thus the scope of this invention is defined in the appended claims rather than by the foregoing particulars. All the modifications and changes are to be interpreted as being included in the claims as far as they are within the scope of the claims.

What is claimed is:

1. In combination a unitary cap seal (1) and a drum equipped with a generally cylindrical mouthpiece (11) having a radially outwardly extending upper portion (11*a*), the cap seal being formed integrally from elastic, resilient material selected from the group consisting of polypropylene, polyethylene, nylon, polystyrene, and polyvinyl chloride, and having a circular top wall (2) and a peripheral wall (3) depending from the top wall, an annular projection (15) which extends downwardly from the top wall and an annular projection (4) extending inwardly from the middle portion of the peripheral wall and then diverging progressively outwardly toward the bottom of the peripheral wall, the inner diameter of the annular projection being less than the outer diameter of the radially outwardly extending upper portion of the mouthpiece whereby the elastic and resilient peripheral wall will be forced outwardly as the diverging portion of the annular projection is pushed downwardly by hand over the radially outwardly extending upper portion of the mouthpiece and the annular projection will return inwardly when the annular projection is positioned below the upper portion of the mouthpiece to retain the cap seal on the mouthpiece, the annular projection (15) engaging the upper portion (11*a*) of the mouthpiece at the upper end of the upper portion (11*a*), the top wall of the cap seal having a removing groove formed therein to facilitate cracking and removal of the cap seal, the inwardly extending annular projections (4) and (15) of the cap seal being provided with a vertically extending groove aligned with the removing groove in the top wall.

* * * * *